US007770762B2

(12) United States Patent
Arghyris et al.

(10) Patent No.: US 7,770,762 B2
(45) Date of Patent: Aug. 10, 2010

(54) DEFORMABLE FLEXIBLE POUCH AND DEVICE FOR PACKAGING AND DISPENSING FLUID PRODUCTS

(75) Inventors: Laurent Arghyris, Boège (FR); Patrice Puviland, La Roche sur Foron (FR); Jean-Philippe Taberlet, Villard (FR)

(73) Assignee: Lablabo, Annemasse (FR)

( * ) Notice: Subject to any disclaimer, the term of this patent is extended or adjusted under 35 U.S.C. 154(b) by 769 days.

(21) Appl. No.: 10/589,200

(22) PCT Filed: Feb. 11, 2005

(86) PCT No.: PCT/FR2005/000329

§ 371 (c)(1),
(2), (4) Date: Aug. 11, 2006

(87) PCT Pub. No.: WO2005/077546

PCT Pub. Date: Aug. 25, 2005

(65) Prior Publication Data

US 2007/0151987 A1 Jul. 5, 2007

(30) Foreign Application Priority Data

Feb. 13, 2004 (FR) ..... 04 01469

(51) Int. Cl.
*B67D 7/60* (2010.01)

(52) U.S. Cl. ..... 222/386.5; 222/95; 222/105; 222/212; 222/215; 222/260; 215/11.3; 215/12.1; 383/120

(58) Field of Classification Search ..... 222/83.5, 222/94–95, 209, 212, 386.5, 105, 107, 214–215, 222/256, 260; 215/11.3, 12.1; 383/120
See application file for complete search history.

(56) References Cited

U.S. PATENT DOCUMENTS 3,223,289 A * 12/1965 Bouet ..... 222/209
3,433,391 A * 3/1969 Fox et al. ..... 222/95
3,606,089 A * 9/1971 Chambers ..... 222/95

(Continued)

FOREIGN PATENT DOCUMENTS

FR 2 669 306 A1 5/1992

(Continued)

OTHER PUBLICATIONS

International Search Report from PCT/FR2005/000329 mailed May 23, 2005.

*Primary Examiner*—Kevin P Shaver
*Assistant Examiner*—Andrew P Bainbridge
(74) *Attorney, Agent, or Firm*—Merchant & Gould LLC

(57) ABSTRACT

This invention is a collapsible flexible pouch that fits into a rigid bottle that is connected to a pump such that the pouch collapses while the bottle remains rigid as the contents of the pouch are pumped out. The pouch has a rigid upper part that serves as a seat for the collapsing pouch, the pouch also having one and only one contraction forming an annular concertina that seats on the upper rigid part of the collapsible pouch which collectively prevents blocking and clogging of the exit opening very effectively. An air inlet is provided in the rigid bottle to prevent a vacuum from forming around the collapsing pouch as its contents are dispensed.

12 Claims, 4 Drawing Sheets

U.S. PATENT DOCUMENTS 3,620,420 A * 11/1971 Normos ..... 222/386.5
4,469,250 A * 9/1984 Evezich ..... 222/83.5
5,123,571 A * 6/1992 Rebeyrolle et al. ..... 222/105
5,370,272 A * 12/1994 Gueret ..... 222/95
5,718,334 A * 2/1998 Demel ..... 206/438
5,934,500 A * 8/1999 Cogger et al. ..... 220/495.06
6,070,763 A * 6/2000 Gueret ..... 222/95

FOREIGN PATENT DOCUMENTS

FR 2 723 356 A1 2/1996
GB 2 083 142 A 3/1982
GB 2 184 491 A 6/1987
WO 00/58021 A1 10/2000

* cited by examiner

FIG. 3
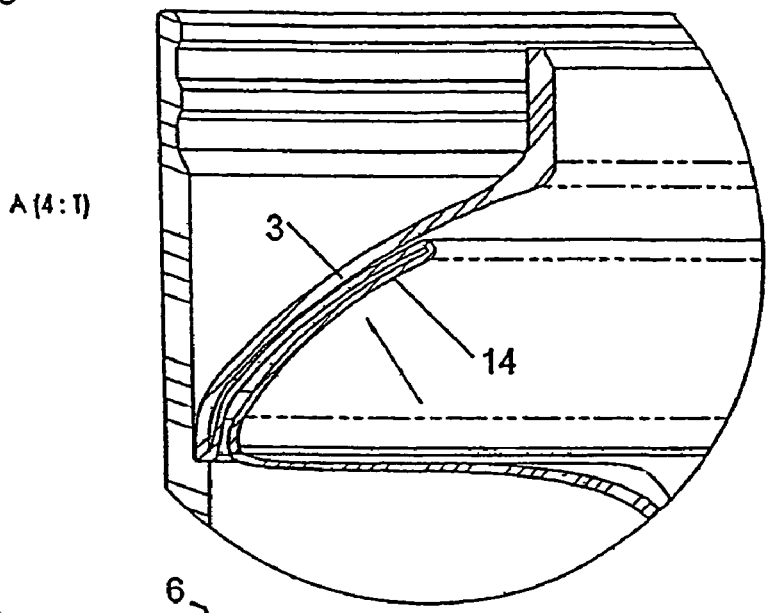
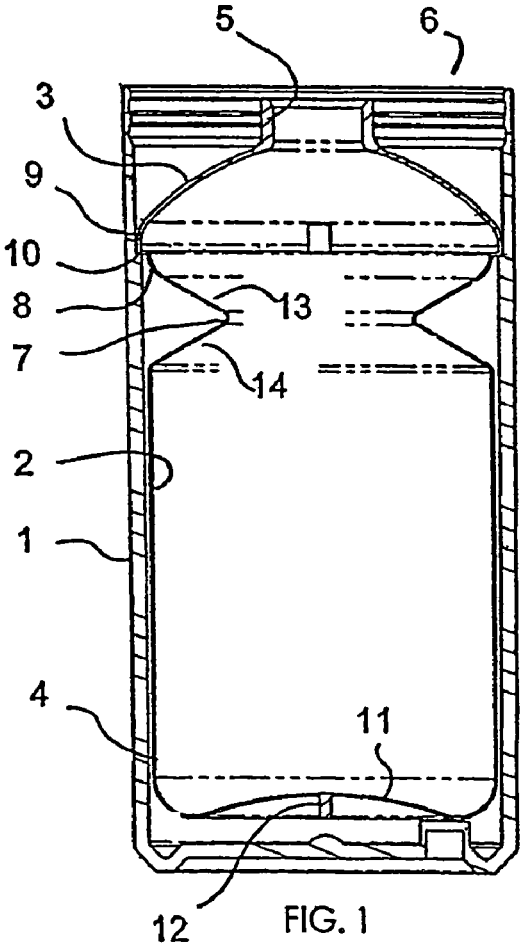
FIG. 1
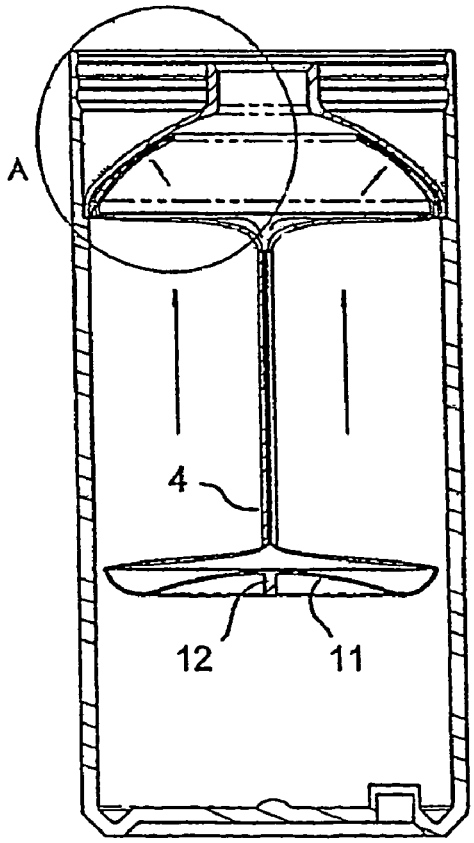
FIG. 2

DEFORMABLE FLEXIBLE POUCH AND DEVICE FOR PACKAGING AND DISPENSING FLUID PRODUCTS

The present invention relates to a device for packaging and dispensing liquid or pasty fluid products and, more particularly, to a flexible pouch assigned or not to a rigid bottle and containing a liquid or pasty fluid product packaged in an airless manner and intended to be dispensed by means of a pump or of a valve, and also to a packaging and dispensing bottle/pouch assembly equipped with such a device.

BACKGROUND OF THE INVENTION

Fluid packaging and dispensing devices of the bottle/pouch type are well known. These devices generally comprise a container with a rigid shell, in which is placed a shrinkable flexible pouch which shrinks in proportion as the product is extracted from it. The expulsion of the product out of the pouch may be obtained by means of an airless pump or without air recuperation or under the pressure of a propellant gas acting in the bottle on the wall of the pouch. As regards the expulsion of the product out of the pouch by means of a pump without air recuperation, a vent is provided, generally in the bottom or in the neck of the bottle, so that the outside air can penetrate into the space located between the bottle and the pouch during each actuation of the pump, thus allowing the pouch to shrink, with sufficient pressure at the same time being maintained on its walls, while keeping the product contained in the pouch, which remains airless. An exemplary embodiment according to this technique is described in the patent FR 2,723,356 relating to a device comprising a pouch made from flexible plastic, such as polyethylene or polypropylene, in a rigid container, the neck of which comprises an air inlet. Pouch systems are also known in which the top part is reinforced in order to make it easier to fasten it to the rigid bottle, and the patent application WO 0058021 describes a pouch according to this technique, although the product volume restored by this type of pouch is generally unsatisfactory, since the deformation of the pouch is limited essentially to the cylindrical part of its wall, and the rate of restoration then cannot hope to reach 90%. This is a disadvantage which is the more serious the higher the value of the product contained in the pouch, and because an appreciable quantity of the product is then lost for the user.

This likewise applies to the pouch described in the patent GB 2,184,491, which comprises two parts having a substantially equivalent volume, the upper part being rigidified by means of ribs, while the flexible lower part shrinks, at the same time returning to the upper part.

The difficulties encountered in these known techniques are often associated with the folds which are formed by the wall of the pouch during its shrinkage and which may limit the fluid dispensing efficiency by forming product retention volumes, and with the difficulty of ensuring a satisfactory leaktightness of the pouch, thus making it possible to maintain the intactness of the product contained in it. To be precise, the products which the pouches contain are often sensitive to oxidation under the action of atmospheric oxygen and may deteriorate if air is introduced into the pouch. The leaktightness faults are often found in the region of the junction of the pouch and of the pump. They may also arise due to a certain porosity of the materials used for producing the pouch. Finally, the folds formed by the wall of the pouch during its shrinkage may cause tears liable to allow air to pass through which then reaches the product contained in the pouch.

Another exemplary embodiment of a bottle/pouch is described in the patent FR 2,770,834 which relates to a device intended for avoiding the piercing and tearing of the pouch during the emptying of the latter. For this purpose, the pouch, produced from flexible material, such as plastic film or aluminum foil, contains a free float preventing an excessive shrinkage of the pouch and thus limiting the risks of tearing. However, the devices of this type have the disadvantage of not ensuring a freeing of the entirety of the product contained in the pouch and consequently of giving rise to appreciable losses of product.

Pouches, the lower part of which comprises a plurality of concertinas, are also known. The document FR 2,669,306 describes a pouch comprising a concertinaed lower part which is progressively accommodated in the frustoconical volume of the rigid upper part, without being laid against the latter. Another example is described in the patent GB 2,083,142 which deals with a pasty product applicator comprising a shrinkable pouch which comprises a plurality of concertinas.

These multiple-concertina pouches have disadvantages. To be precise, during filling, air inclusions risk being trapped in the folds, all the more because the viscosity of the product intended for filling the pouch is high. Moreover, the multiple concertinas have the effect of retaining the product and consequently of reducing the restoration rate of the pouch.

The pumps usually assigned to the flexible pouches must ensure good leaktightness and be capable of functioning both in the vertical position and in an inclined position. The patent FR 2,669,379 describes a metering pump affording good leaktightness even in the event of a change in position, of the axial piston type carrying a sliding floating piston comprising three flap valves. The patent FR 2,726,810 describes an example of a pump without an air inlet, in which the lower flap valve is flexible and frustoconical, while the upper flap valve is carried by a disk placed at the base of the hollow stem of the tappet.

SUMMARY OF THE INVENTION

One subject of the present invention is a deformable flexible pouch capable of containing liquid or pasty food products and assigned to means intended for ensuring the dispensing of said products without the return of air into the pouch.

Another subject of the invention is a device for packaging and dispensing liquid or pasty food products of the type of a rigid bottle with a flexible pouch, comprising a flexible pouch, as described above, ensuring an excellent restoration of the product contained in the pouch, whatever the position of the rigid bottle.

Yet another subject of the present invention is a deformable flexible pouch intended to be fastened in a rigid bottle carrying an airless manual pump fitted to the orifice of the pouch in a leaktight manner.

A further subject of the invention is a device for packaging and dispensing liquid or fluid products of the type of a rigid bottle with a vent, comprising a flexible pouch, as described above, mounted in a leaktight manner on a bottle provided with a vent, and assigned to a device for extracting and dispensing the product contained in the pouch.

BRIEF DESCRIPTION OF THE DRAWINGS

FIG. 1 shows a sectional view of the pouch of the invention placed in a rigid bottle.

FIG. 2 shows a sectional view of the pouch of FIG. 1 in the shrinkage position.

FIG. 3 shows an enlarged sectional view showing a detail of the upper part of the pouch of FIG. 2.

DETAILED DESCRIPTION OF THE PREFERRED EMBODIMENTS

Figure 4:
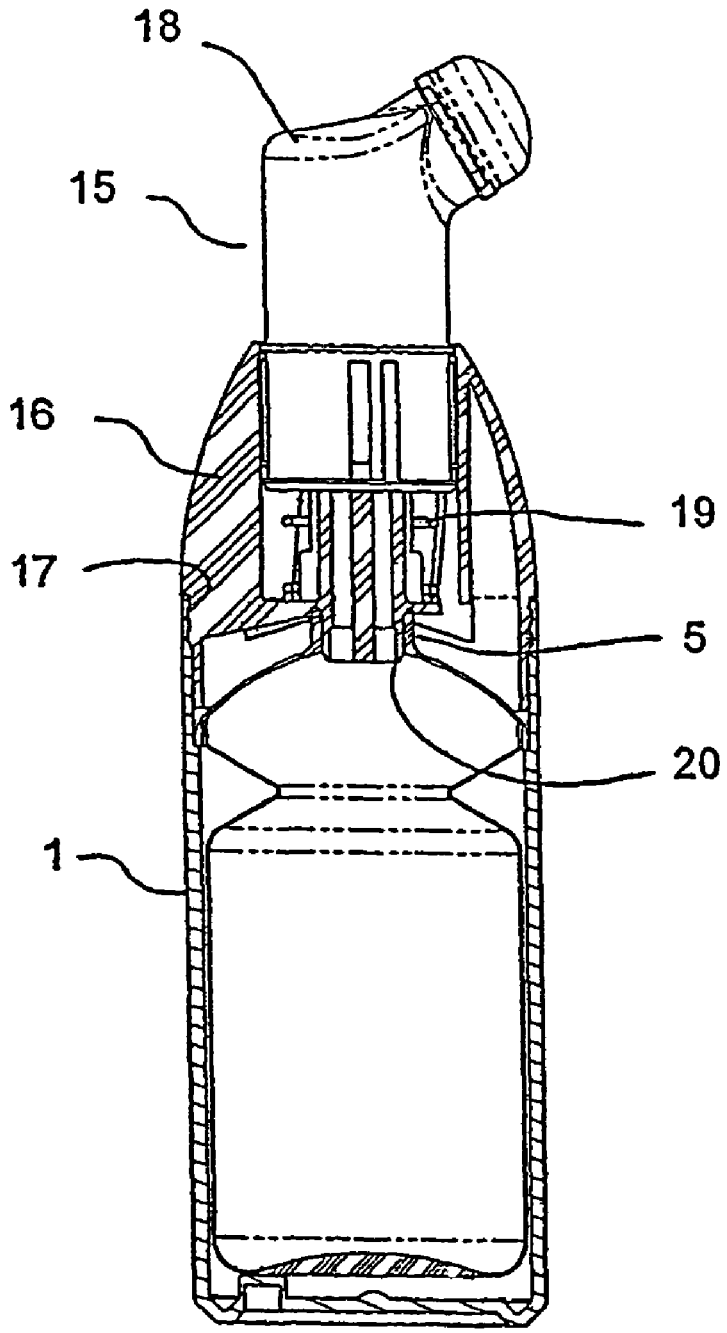
FIG. 4 shows a sectional view of an assembly comprising a flexible pouch according to the invention assigned to a rigid bottle and a manual pump.

According to the present invention, the deformable flexible pouch is of the one-piece type capable of containing liquid or pasty fluid products, which comprises a rigid upper part comprising an orifice neck and a flexible and deformable lower part and is assigned to means intended for ensuring the dispensing of said products without the return of air into the pouch, the two parts being articulated on one another in such a way that the top of the inner wall of the lower part is laid against the inner wall of the upper part during the shrinkage of the pouch.

This pouch is distinguished in that its flexible lower part has a contraction forming a concertina having a form such that it is folded back onto the inner wall of the rigid upper part when it shrinks, said contraction being formed in the upper part of the flexible pouch.

The presence of a single contraction in the upper part of the flexible pouch has, in particular, the advantage of allowing an easy filling of the pouch, whatever the viscosity of the product used.

According to a preferred embodiment of the invention, the inside diameter of the contraction is slightly greater than the diameter of the neck of the pouch.

The rigid upper part of the pouch has a substantially frustoconical form, and its rigidity is sufficient to prevent any deformation of this part of the pouch during the shrinkage of the latter. According to a preferred embodiment, this upper part of the pouch has the form of a dome opening at its center in order to be connected to the neck of the pouch.

The top of the flexible lower part of the pouch has a contraction, as mentioned above, arranged in such a way that the wall of the pouch adjacent to this contraction, on the same side as the neck of the pouch, is of substantially frustoconical form, the base of this flexible cone frustum being connected to the base of the rigid frustoconical upper part along the zone of articulation of the two parts to one another.

In order to make it easier to fold the inner wall of the top of the flexible lower part back against the dome-shaped inner wall of the rigid upper part without an interspace, it is preferable if the diameter of the base of the rigid upper part supporting the zone of articulation to the lower part of the pouch is slightly greater than the outside diameter of the zone of connection of the contraction to the side wall of the pouch, in such a way that, after the top of the flexible lower part of the pouch has been folded back against the rigid upper part, the base of the latter projects slightly beyond the wall of the lower part of the pouch.

Moreover, this embodiment has the advantage of forming a bearing zone capable of coming into contact with a shoulder formed in the top of the wall of the bottle, in order to make it easier to position the pouch in the bottle.

According to another characteristic of the present invention, the base of the flexible pouch has a concave form reinforced by means of a diametral crossmember which makes it easier to hold this part of the pouch when the latter shrinks.

According to an advantageous characteristic of the present invention, the flexible lower part of the pouch is designed in such a way that it shrinks according to a movement in two stages, first being folded back against the inner wall of the rigid upper part and subsequently executing a movement of ascent from the bottom of the pouch toward the neck. Thus, the fact that the flexible lower part, in a first stage, is laid against the inner wall of the rigid upper part by virtue of the presence of the contraction makes it possible to reinforce this inner wall. This advantageously increases the rigidity of the upper part prior to the movement of ascent from the bottom of the pouch which takes place in a second stage.

The flexible pouch according to the present invention has the advantage of possessing a rigid upper part assigned to a flexible lower part, of which the form, during the shrinkage of the pouch in proportion as the product which is contained in it is extracted, is complementary to that of the rigid part, in such a way that the restoration rate of the product, that is to say the ratio of the quantity extracted to the quantity initially contained in the pouch, is higher than 95% and even higher than 99%, depending on the type of product contained in the flexible pouch.

More particularly, the upper part of the pouch combines high rigidity and a relatively small thickness, while the smaller thickness of the lower part makes it an authentic flexible pouch capable of shrinking completely, not just a flexible bottle.

Various conventional pumps of the type without an air inlet (airless pumps) may be used in the invention in order to extract and dispense the products contained in the pouch. Pumps with flap valves capable of functioning according to varied orientations may advantageously be used. The flap valves of the pump may be produced from any material having the desired characteristics of flexibility and of elasticity and compatible with the products contained in the bottle. As an example, use may be made of flap valves consisting of natural or synthetic rubber or of thermo-plastic elastomers, such as thermoplastic polyesters, polyurethanes or SBS, or even silicones.

It may be advantageous, according to the invention, to mount the pump in a leaktight manner on the rigid bottle containing the flexible pouch by means of a ring or a cap. According to one variant, the pump is mounted directly on the bottle by means of any conventional technique, for example by interlocking, snapping, adhesive bonding, welding or screwing.

According to one embodiment, the pump is mounted on a ring secured to the neck of the pouch and bearing on the edges of the bottle, said ring being in the form of an open cylinder. For this purpose, the edges of the orifice of the bottle comprise means cooperating with the ring in order to ensure the fastening of the latter. For example, one or more grooves may be provided which are formed in the inner wall of the edge of the orifice of the bottle and cooperate with corresponding ribs on the periphery of the fastening ring for fastening by snapping. The fastening of the pump to the ring may be carried out by means of the same technique or by welding. According to one variant, the ring may be integrated into the neck of the pouch and be formed together with the latter.

According to a preferred embodiment of the invention, the pump is mounted directly on the neck of the pouch. The high rigidity of the upper part in the form of a cone frustum or of a dome is sufficient to make it possible to install the pump and hold it during use. This characteristic of the invention is advantageous since it avoids the need to use an intermediate ring. However, such a ring may be used in particular configurations which involve a reinforcement of the structure carrying the pump.

In the absence of an intermediate ring, the pouch is held in place on the rigid bottle by snapping or screwing, by means which are provided on the periphery of its rigid upper part and cooperate with the upper edge of the bottle, for example grooves formed in the periphery of the ring and corresponding to ribs in the inner wall of the bottle, or vice versa. In a variant according to the invention, the pouch is simply placed on the orifice of the bottle, the periphery of its rigid upper part resting on a shoulder formed in the inner wall of the bottle. The assembly is subsequently locked in position by means of the body of the pump which is fastened on the orifice of the rigid bottle by conventional means, from above the pouch. The pouch is itself fastened to the plunger tube of the pump by interlocking or clamping.

According to the conventional techniques of flexible pouches, the rigidity of the upper part of the pouch is generally considered to be a disadvantage, since it opposes the complete shrinkage of the flexible pouch and therefore reduces the restoration rate. On the contrary, the present invention utilizes this rigid structure in order to make it easier to install the pouch on a rigid bottle, at the same time optimizing the folding back of the pouch according to a movement which matches the rigid structure, in such a way that the restoration rate is higher than 95%.

The rigidity of the upper part of the pouch and the flexibility of the lower part are obtained, for example, by imparting a suitable thickness to the wall of each of these parts which are formed in one piece from the same material. For the same thickness, the rigidity also varies in a known way as a function of the form of the wall.

As regards a device of the type of a rigid bottle with flexible pouch, the outside air must enter the space separating the flexible pouch from the inner wall of the rigid bottle in order to maintain there a sufficient pressure to ensure that the pouch can shrink during each expulsion of product. An air inlet circuit is therefore provided so that the outside air can penetrate into the bottle and compensate the product volume expelled by the pump. According to one embodiment, this air circuit is located in the region of the tappet of the pump and comprises means for ensuring that the latter is shut off when the tappet is raised, in the position of rest.

As regards a simple rigid bottle, the air circuit may consist of venting, preferably in the bottom of the bottle.

According to an advantageous embodiment, in the bottom of the rigid bottle, a vent is provided which is equipped with a flap valve, to prevent any leakage of the product contained in the bottle, and with a filter to prevent the introduction of pollutants, such as bacteria, which could damage the product to be dispensed.

According to a simple alternative embodiment, the venting consists of one or more longitudinal grooves formed on the periphery of the base of the rigid upper part of the pouch, in the zone of articulation between the upper part and the lower part. In the case of the fastening of the pump by means of a ring bearing on the bottle, one or more orifices are made in the ring in order to allow the passage of air.

In order to ensure a high leaktightness of the assembly consisting of the bottle, pump and flexible pouch, including in situations where this assembly would be in a zone of sufficiently low pressure to be capable of causing an opening of the flap valves of the pump and of giving rise to a leak of the product contained in the metering chamber, it may be advantageous to provide a cap or cowl mounted removably on the dispensing head.

Means may be provided for ensuring the leaktightness of the mounting of the cowl on the head, and, for example, the cowl may be installed by interlocking owing to a complementary form of the inner edge of the cowl and of the base of the nose of the tappet receiving it, this mounting being completed by an O-ring or sealing beads.

Such an accessory completing the pump and its tappet ensures excellent leaktightness under all storage conditions, even in the event of a fall in the outside pressure, and makes it possible to ensure that the product contained in the bottle is preserved.

The pump, fastened to the neck of the flexible pouch of the invention by means of a ring or directly, is generally produced from plastic, such as polyethylene or polypropylene of a suitable density for giving it the desired mechanical properties.

The pouch may be produced from a plastic selected, for example, from a polyethylene, a polypropylene, a polyamide, a copolymer of ethylene and of vinyl alcohol (EVOH), a low-density polyethylene, a polyethylene terephthalate (PET), a polyvinylchloride (PVC), a polyurethane, etc. These may be unilayer materials or multilayer complexes including a metallic layer, for example an aluminum layer forming a barrier which reinforces leaktightness, combined with one or more plastic layers.

According to an advantageous embodiment of the invention, the pouch may be manufactured by means of blowing techniques in one piece from the above materials, thus making it possible appreciably to reduce the investment necessary for manufacture and consequently to reduce the manufacturing cost. The method of manufacturing a one-piece pouch by blowing or extrusion blowing also makes it possible to avoid the need to produce a molded component and to dispense with an assembling operation, as compared with a conventional technique.

According to one variant, it is possible to carry out the injection blowing of a preform in a suitable mold, but this technique is usually much more costly. It may, however, be suitable for particular embodiments, for example when it is desirable to integrate the fastening ring directly in the neck of the pouch during its manufacture. The blowing technique which can be used for manufacturing the flexible pouch of the invention makes it possible to reduce the costs considerably, as compared with the techniques, especially injection blowing, currently adopted in this field.

The flexible pouch according to the invention is preferably produced from a material suitable for the product which it contains. Thus, as an example, it may consist of low-density polyethylene when it is to contain a cream relatively insensitive to the effects of the external surroundings, while it may consist of a polyamide affording better protection against the effects of oxygen and against loss by the evaporation of water vapor when it is to contain a more fragile product.

The thickness of the wall of the pouch varies as a function of the rigidity desired for the upper part and of the flexibility for the lower part and as a function of the material used. Suitable material thicknesses can easily be determined by a person skilled in the art. For example, where a wall made from polyethylene or from polyamide is concerned, the thickness of the neck of the pouch may be between 0.5 and 1.5 mm, that of the rigid upper part between 0.2 and 0.3 mm and that of the flexible lower part between 0.1 and 0.2 mm.

The outer surface of the rigid bottle may carry informative or decorative inscriptions applied directly by screen printing or by the adhesive bonding of a film or foil of suitable material. Of course, it is possible for the rigid bottle containing the pouch not to be used and for inscriptions to be capable of being applied directly to the surface of the pouch.

Figure 5:
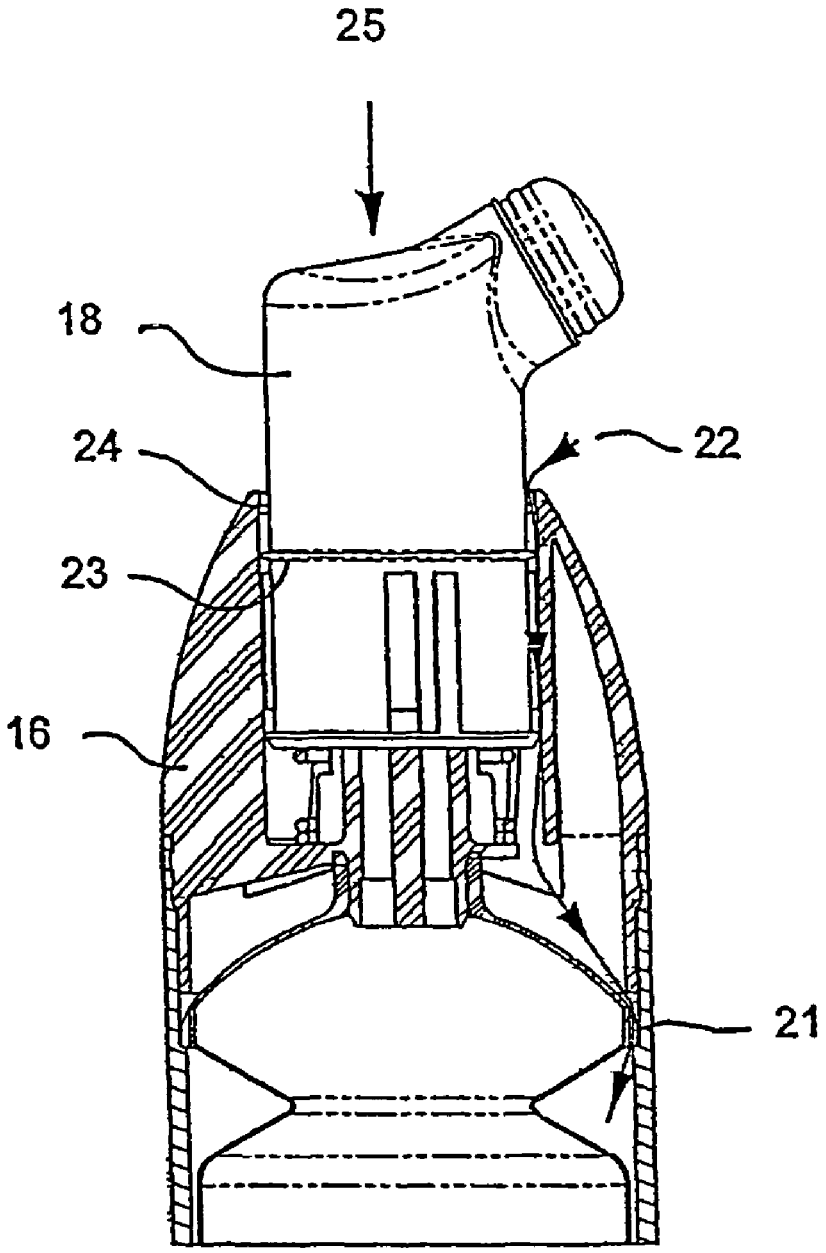
FIG. 5 shows an enlarged sectional view showing a detail of the air circuit of the bottle/pouch of FIG. 4.
Figure 6:
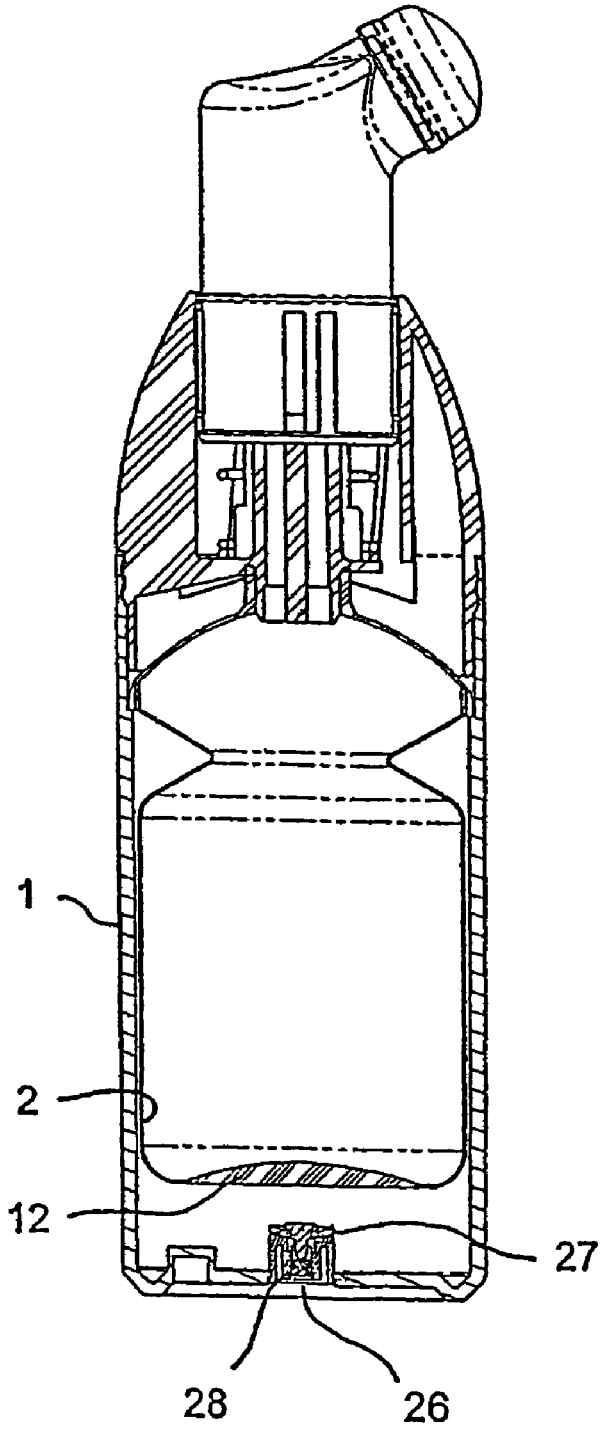
FIG. 6 shows a sectional view of a variant of the bottle/pouch of FIG. 4 comprising a vent in the bottom of the rigid bottle.

The advantages and characteristics of the pouch according to the present invention will become apparent from the non-limiting exemplary embodiments described in more detail below, with reference to the accompanying drawings, in which:

FIG. 1 shows a sectional view of the pouch of the invention placed in a rigid bottle, FIG. 2 shows a sectional view of the pouch of FIG. 1 in the shrinkage position, FIG. 3 shows an enlarged sectional view showing a detail of the upper part of the pouch of FIG. 2, FIG. 4 shows a sectional view of an assembly comprising a flexible pouch according to the invention assigned to a rigid bottle and a manual pump, FIG. 5 shows an enlarged sectional view showing a detail of the air circuit of the bottle/pouch of FIG. 4, and FIG. 6 shows a sectional view of a variant of the bottle/pouch of FIG. 4 comprising a vent in the bottom of the rigid bottle.

FIG. 1 illustrates a bottle (1) containing a flexible pouch (2) comprising a rigid upper part (3) and a flexible lower part (4), and opening via a neck (5) issuing via the orifice (6) of the bottle (1). The entire pouch (2) is produced in one piece by the blowing of a single material (low-density polyethylene).

The rigidity of the neck (5) of the pouch is ensured by means of a material overthickness, while the upper part (3) has the form of a dome, the rigidity of which is obtained by means of a sufficient thickness (approximately 0.2 mm) of the material combined in the form of a dome.

The flexible lower part (4) of the pouch (2) has a contraction (7) forming a concertina. It is articulated to the rigid upper part (3) by means of the particular form of the offset junction (8) with respect to the peripheral edge (9) of the dome (3) which is in continuous contact with the inner wall of the bottle (1) and rests on the shoulder (10), as illustrated in more detail in FIG. 3.

The bottom (11) of the pouch has a slightly concave form, and a crossmember (12) is formed there in order to prevent excessive deformation during the shrinkage of the pouch, as mentioned below.

The actuation of the pump (not illustrated) mounted on the neck (5) of the pouch causes the progressive shrinkage of the pouch (2).

In a first stage, the frustoconical part (13) located between the contraction (7) and the dome-shaped rigid upper part (3) of the pouch lifts up at the same time as the bottom (11) ascends toward the neck, until this frustoconical part (13) is laid against the inner wall of the rigid dome (3). The frustoconical part (14) located under the contraction (7) is then, in turn, folded back and laid against the frustoconical part (13).

The side walls of the pouch (2) shrink progressively, as illustrated in FIG. 2, and this movement is accompanied by the ascent of the bottom (11) of the pouch, the form of which is substantially maintained by means of the crossmember (12).

As shown in FIG. 3, the frustoconical parts (13) and (14) located in either side of the contraction (7) are folded back under the inner face of the rigid dome (3), the edge (9) of which remains in bearing contact on the shoulder (10) formed in the inner wall of the bottle (1). The frustoconical form opening toward the bottom of the wall (14) of the pouch makes it easier for the top of the flexible pouch to be folded back, at the same time limiting the dead spaces to a minimum, thus ensuring an excellent restoration rate.

In FIG. 4, the pump (15) is mounted on the body of the rigid bottle (1) by means of the pump body (16) which comprises a cylindrical skirt (17) which is interlocked on the orifice of the rigid bottle (1). The pump is actuated by means of a tappet (18) acting against a spring (19) and comprises a tube (20) coming into position on the neck (5) of the pouch (2) in a leaktight manner. Since both the pump and its fastening to the neck (5) of the pouch (2) are leaktight, an air inlet circuit is provided so that the outside air can penetrate into the space separating the pouch from the inner wall of the bottle, in order to maintain there a sufficient pressure to ensure that the pouch can shrink during each expulsion of product. This air circuit is illustrated in FIG. 5.

It is produced by means of notches (21) made in the wall of the peripheral edge (9) of the rigid dome (3) of the pouch, so as to form a duct allowing the air to pass from outside, between the walls of the tappet (18) of the pump (15) and the cylindrical hole of the pump body (16) in which it slides, and between the edge of the rigid dome and the inner wall of the bottle, into the volume between the pouch (2) and the bottle (1) according to the arrow (22).

The air circuit can be shut off by means of a ring (23) mounting on the wall of the tappet (18) and cooperating with an annular stop (24) formed at the entrance of the cylindrical hole of the pump body (16) in which the tappet slides. At rest, the ring is against the stop and the air circuit is closed. When the user actuates the tappet (18) in the direction of the arrow (25), the ring moves away from the stop and opens the air circuit. The outside air can then penetrate into the volume between the pouch and the rigid bottle and compensate the shrinkage of the flexible pouch.

FIG. 6 illustrates a variant of the bottle/pouch of FIG. 4, where the air circuit is replaced by a vent in the bottom of the rigid bottle (1). This vent (26) is closed by means of a flap valve (27), to prevent any leakage of the product contained in the bottle. It is completed by a filter (28) which makes it possible to prevent the introduction of pollutants, such as bacteria. The flap valve is designed so as to open when a vacuum occurs in the bottle during each actuation of the pump and to remain closed when the tappet of the pump is at rest.

The tests conducted with a device, as illustrated in FIG. 1, comprising a conventional pump without air return, revealed restoration rates of the order of 95% in the case of creams, depending on their viscosity, and of higher than 95% in the case of liquids.

The invention claimed is:

1. A deformable flexible pouch for liquid or pasty fluid products comprising: a rigid upper part (3) comprising an orifice neck (5) and a flexible and deformable lower part (4) and the two parts (3, 4) being articulated on one another such that the top of the inner wall of the lower part (4) is laid against the inner wall of the upper part (3) during the shrinkage of the pouch (2), wherein the flexible lower part (4) of the pouch has only one contraction (7) forming a concertina having a form such that it is folded back onto the inner wall of the rigid upper part (3) when it shrinks, said contraction (7) being formed in the upper part of the flexible pouch (2).

2. The flexible pouch as claimed in claim 1, wherein the inside diameter of said contraction (7) is slightly greater than the diameter of the neck (5) of the pouch.

3. The flexible pouch as claimed in claim 1, wherein the upper part (3) of the pouch has a substantially frustoconical form, and its rigidity is sufficient to prevent any deformation of this part of the pouch during the shrinkage of the latter.

4. The flexible pouch as claimed in claim 3, wherein the upper part (3) of the pouch has the form of a dome opening at its center in order to be connected to the neck (5) of the pouch.

5. The flexible pouch as claimed in claim 1, wherein the contraction (7) in the upper part of the flexible pouch is arranged in such a way that the wall (13) of the flexible pouch which is adjacent to this contraction, on the same side as the neck (5) of the pouch, is of substantially frustoconical form, the base of this flexible cone frustum being connected to the base of the rigid frustoconical upper part (3) along the zone of articulation of the two parts to one another.

6. The flexible pouch as claimed in claim 5, wherein the diameter of the base of the upper part (3) supporting the zone of articulation to the lower part (4) of the pouch is slightly greater than the outside diameter of the zone of connection of the contraction (7) to the side wall of the pouch.

7. The flexible pouch as claimed in claim 1, wherein the base of the flexible pouch (2) has a concave form (11) reinforced by means of a diametral crossmember (12).

8. A device for packaging and dispensing liquid or pasty fluid products, wherein it comprises a flexible pouch as claimed in claim 1, assigned to a rigid bottle (1) and to a manual pump without an air inlet (15).

9. The device as claimed in claim 8, wherein the pouch (2) is mounted on the neck (5) of the rigid bottle (1) in a leaktight manner and comprises an air circuit (22) consisting of one or more transverse grooves (21) formed on the periphery (9) of the base of the rigid upper part (3) of the pouch, in the zone of articulation between the upper part (3) and the lower part (4).

10. The device as claimed in claim 8, wherein the pouch is mounted in a leaktight manner on the neck (5) of the rigid bottle (1), the bottom of which comprises a vent (26) equipped with a flap valve (27) and with a filter (28).

11. The device as claimed in claim 8, wherein the periphery (9) of the rigid upper part (3) of the pouch rests on a shoulder (10) formed in the inner wall of the bottle (1).

12. The device as claimed in claim 11, wherein the body (16) of the pump is fastened to the orifice (6) of the rigid bottle (1) by conventional means from above the pouch (2).

* * * * *